US009346255B2

(12) United States Patent
McClure et al.

(10) Patent No.: US 9,346,255 B2
(45) Date of Patent: May 24, 2016

(54) COMPOSITIONS AND METHODS FOR MAKING PUTTY TRANSFER BOOKS

(71) Applicant: Crayola LLC, Easton, PA (US)

(72) Inventors: David McClure, Roanoke, VA (US); Keith Ketchman, Rosemont, IL (US); Michael Craig, Sciota, PA (US)

(73) Assignee: Crayola LLC, Easton, PA (US)

( * ) Notice: Subject to any disclaimer, the term of this patent is extended or adjusted under 35 U.S.C. 154(b) by 0 days.

(21) Appl. No.: 14/657,469

(22) Filed: Mar. 13, 2015

(65) Prior Publication Data

US 2015/0183207 A1 Jul. 2, 2015

Related U.S. Application Data

(62) Division of application No. 13/800,780, filed on Mar. 13, 2013, now Pat. No. 8,978,556.

(51) Int. Cl.

| | |
|---|---|
| ***B41M 1/26*** | (2006.01) |
| ***B41M 1/30*** | (2006.01) |
| ***B41M 3/12*** | (2006.01) |
| ***B41M 5/03*** | (2006.01) |
| ***B41F 7/02*** | (2006.01) |
| ***B41M 5/025*** | (2006.01) |

(52) U.S. Cl.

CPC .. *B41F 7/02* (2013.01); *B41M 1/26* (2013.01); *B41M 1/30* (2013.01); *B41M 3/12* (2013.01); *B41M 5/025* (2013.01); *B41M 5/03* (2013.01); *B41M 2205/10* (2013.01); *Y10T 428/24802* (2015.01)

(58) Field of Classification Search

CPC ..... B41M 1/26; B41M 1/30; B41M 3/12; B41M 5/03; B41M 2205/10; B41F 7/02; Y10T 428/24802; Y10T 428/914; Y10S 429/914; Y10S 428/914

USPC ..... 156/235; 101/142, 492; 283/100; 428/195.1, 14, 914

See application file for complete search history.

(56) References Cited

U.S. PATENT DOCUMENTS

| | | | |
|---|---|---|---|
| 3,146,144 | A | 8/1964 | Lemelson |
| 3,311,521 | A | 3/1967 | Hofrichter |
| 5,753,020 | A | 5/1998 | Minuto |

(Continued)

OTHER PUBLICATIONS

Gray, D., Ceramic Arts Daily Lesson Plan "Ink Transfers on Clay," 2010 Ceramic Publications Company.

(Continued)

*Primary Examiner* — Bruce H Hess
(74) *Attorney, Agent, or Firm* — RatnerPrestia

(57) ABSTRACT

The present invention provides kits and methods for selectively transferring a portion of an image from a substrate (e.g., paper) to a dough (e.g., Silly Putty®) comprising pressing the dough onto an image printed on the substrate. The image comprises transferable ink and non-transferable ink. At least a portion of the image comprising transferable ink transfers from the substrate to the dough and the non-transferable ink does not transfer from the substrate to the dough. The dough can be used to reveal an image that was "hidden" within the visible image printed on the substrate. The present invention also provides methods for making a substrate with an image comprising transferable ink (e.g., cold-set web ink) and non-transferable ink (e.g., sheet-fed offset ink) printed thereon, comprising using a sheet-fed offset press to print the image onto the substrate.

9 Claims, 1 Drawing Sheet

(56) References Cited

U.S. PATENT DOCUMENTS

| | | | |
|---|---|---|---|
| 5,951,057 | A | 9/1999 | Spector |
| 6,506,445 | B2 | 1/2003 | Popat |
| 6,612,233 | B2 | 9/2003 | Fujimoto |
| 6,881,781 | B1 | 4/2005 | Gamba |
| 7,448,650 | B2 | 11/2008 | Hengsbach |
| 2008/0295712 | A1 | 12/2008 | Craswell |

OTHER PUBLICATIONS

Non-Final Office Action dated Jul. 17, 2014 for U.S. Appl. No. 13/800,780.

Notice of Allowance dated Nov. 7, 2014 for U.S. Appl. No. 13/800,780.

COMPOSITIONS AND METHODS FOR MAKING PUTTY TRANSFER BOOKS

CROSS-REFERENCE TO RELATED APPLICATION

This application is a divisional of U.S. application Ser. No. 13/800,780, filed Mar. 13, 2013, which is incorporated by reference herein in its entirety and for all purposes.

FIELD OF THE INVENTION

The present invention relates generally to kits and methods for transferring an image from a substrate to a dough. In particular, the present invention relates to kits and methods for using a dough to selectively transfer a portion of an image from one substrate to another.

BACKGROUND OF THE INVENTION

There are many different types of printing processes that are used to print ink-based images onto substrates, such as paper. Three types of presses that are well-known for large-volume printing include sheet-fed offset presses, heat-set offset presses, and cold-set web presses. Due to the vast differences among these presses, inks are specially developed for each type of press. Thus, cold-set web inks are used with cold-set web presses, sheet-fed offset inks are used with sheet-fed offset presses, and heat-set offset inks are used with heat-set offset presses.

Cold-set web inks have comparably high mineral oil content, low resin content, and low viscosity compared to sheet-fed offset and heat-set offset inks. Cold-set web inks are designed to dry by absorption onto paper and by air. On the contrary, the inks for sheet-fed offset presses and heat-set offset presses are petroleum oil-based or vegetable/soy oil-based and have resins and driers built in to ensure the inks cure to a hardened state. Sheet-fed presses typically have IR or UV driers, and heat-set presses typically have natural/propane gas drying units that help cure the ink. The inks for sheet-fed offset and heat-set web offset are designed to cure, preferably completely, either during the printing process or through oxidation and chemical reactions soon thereafter. Cold-set presses and inks are much different. Generally, cold-set printing does not require built-in driers for curing the ink, as cold-set inks are developed to dry by absorption onto paper and by air.

Cold-set web presses are generally considered to provide lower quality printing (e.g., lower resolution) in comparison to sheet-fed offset and heat-set offset presses. The viscosities of inks used with sheet-fed presses are typically much higher in comparison to cold-set web inks, and can therefore print with much higher resolution. Lower viscosity inks tend to expand too much on the substrate to provide the level of resolution provided by sheet-fed presses and inks. Heat-set web offset presses provide similar quality printing as sheet-fed offset presses, but are typically used for higher volume runs. Heat-set web inks often have silicone in them, and are developed specifically for the type of substrate that will be printed.

There remains a need for new printing systems that can provide novel consumer products with creative end uses.

SUMMARY OF THE INVENTION

An embodiment of the present invention provides a method for selectively transferring a portion of an image from a substrate (e.g., paper) to a dough (e.g., a putty, such as Silly Putty®) comprising pressing the dough onto an image printed on the substrate. The image comprises both transferable ink and non-transferable ink. At least a portion of the image comprising transferable ink transfers from the substrate to the dough and the non-transferable ink does not transfer from the substrate to the dough. When the dough is lifted off the substrate and pressed onto a second substrate, the transferable ink is transferred from the dough to the second substrate. In particular embodiments, the dough can be used to reveal an image that was "hidden" within the visible image printed on the substrate.

Another embodiment of the present invention provides a kit comprising at least one substrate (e.g., paper), wherein at least one image is printed on each substrate, and each image comprises transferable ink and non-transferable ink. According to preferred embodiments, the kit further comprises one or more pieces of dough (e.g., Silly Putty®).

Another embodiment of the present invention provides a method for making a substrate with transferable and non-transferable inks printed thereon, the method comprising using a sheet-fed offset press to print an image onto a surface of the substrate, the image comprising transferable ink and non-transferable ink. The transferable ink preferably comprises one or more cold-set web inks and the non-transferable ink preferably comprises one or more sheet-fed or heat-set web inks.

DETAILED DESCRIPTION OF THE INVENTION

Figure 1:
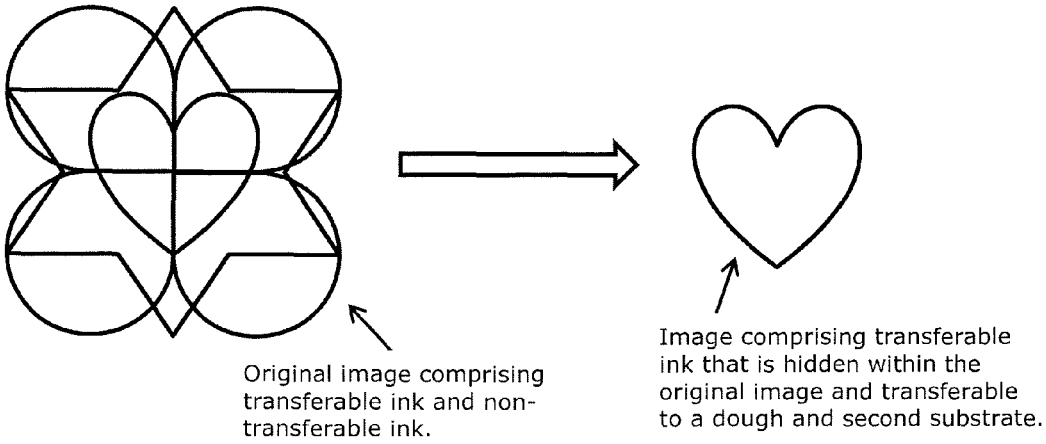
FIG. 1 illustrates an embodiment of the "secret reveal" capabilities of the present invention.
Figure 2:
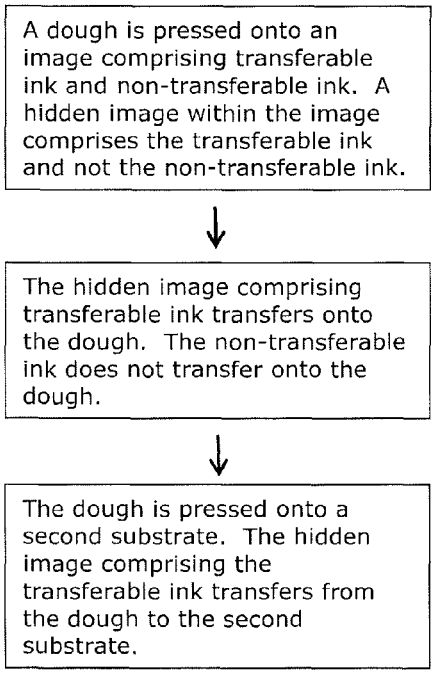
FIG. 2 schematically illustrates a method for transferring a hidden image to a second substrate, in accordance with an embodiment of the present invention.

Embodiments of the present invention provide kits and methods for selectively transferring a portion of a printed image from a substrate to a dough, such as Silly Putty®, and from the dough to another substrate. The applicants have discovered that a sheet-fed offset press can be used to print both cold-set web inks, which are transferable onto dough, and sheet-fed offset inks, which are not transferable onto dough, onto the same substrate.

The kits and methods described herein are particularly suitable for use by children. The dough can be used to reveal an image that was "hidden" within the visible image printed on the substrate. After the user presses the dough onto the image, only a portion of the visible image (the "hidden image") transfers onto the dough. The image on the dough can then be transferred onto a second substrate by pressing the dough onto the second substrate, so that the hidden image from the first substrate can be seen. For example, the visible image on the substrate may comprise an artistic design, and the portion of the image that is transferable off of the substrate onto the dough may be a shape or figure, such as a heart or cartoon character, that is hidden within the artistic design. A user can therefore enjoy the "secret reveal" capabilities of the present invention by using the dough to find out what image is hidden within the design.

In order to provide these "secret reveal" capabilities, the image printed on the substrate comprises two different types of ink—one that is transferable onto the dough, and one that is not transferable onto the dough. The portion of the image that is transferable onto the dough, and then onto a second substrate, comprises transferable ink, whereas the portion of the image that is not transferable comprises non-transferable ink. According to preferred embodiments, a user will not be able to tell by looking at the image which portions are transferable and which are not, i.e., the user will not be able to discern the transferable, hidden image within the visible image.

According to an embodiment of the present invention, a method for transferring an image comprises pressing a dough onto an image printed on a substrate, the image comprising transferable ink and non-transferable ink. Upon pressing the dough onto the image, at least a portion of the image comprising transferable ink transfers from the substrate to the dough. Preferably, the entire portion of the image comprising transferable ink transfers from the substrate to the dough. The non-transferable ink does not transfer from the substrate to the dough, and is therefore not visible on the dough and not transferable to the second substrate. When the dough is lifted off the surface of the substrate and pressed onto a second substrate, the transferable ink is transferred from the dough to the second substrate. According to a preferred embodiment, the method comprises pressing the dough onto the image with sufficient force to cause at least a portion of the transferable image comprising transferable ink (or the entire transferable image comprising transferable ink) to transfer from the substrate to the dough. Preferably, the dough is then pressed onto a second substrate with sufficient force to cause the transferable ink to transfer from the dough to the second substrate.

Stated another way, an image is printed on the substrate, with the image comprising a transferable portion, i.e., a "transferable image," and a non-transferable portion, i.e., a "non-transferable image." The transferable image comprises or consists of transferable ink, and may also be referred to as a "hidden image." The non-transferable image comprises or consists of non-transferable ink. The transferable image and non-transferable image are preferably printed on the substrate so that the transferable image is hidden within the image (e.g., one or more portions of the transferable image and non-transferable image overlap and/or overlay each other so that a user cannot tell which portion(s) of the image are transferable). One or more portions of an image may comprise both non-transferable ink and transferable ink printed on top of each other (i.e., one overlays the other—this may be considered "trapping" in the printing industry, which is a process of printing one or more inks so that they overlap each other or abut each other); one or more portions of the image may comprise only non-transferable ink; and one or more portions of the image may comprise only transferable ink. Preferably, a user cannot tell from looking at the image which portion(s) (if any) comprise non-transferable ink and transferable ink printed on top of each other, which portion(s) (if any) comprise only non-transferable ink, and which portion(s) (if any) comprise only transferable ink. A user will preferably not be able to see the hidden, transferable image until it has been transferred to the dough (by looking at the image on the dough), and/or until it has been transferred to the dough and then to the second substrate (by looking at the second substrate).

Thus, the methods of the present invention allow for the "selective" transfer of an image from a first substrate to a second substrate because only the portion of the image comprising transferable ink is transferable from the first substrate to the dough, and from the dough to the second substrate; whereas the non-transferable ink is not transferable from the first substrate to the dough, and therefore the portion of the image comprising only non-transferable ink is not transferable from the first substrate to the dough, and from the dough to the second substrate.

As used herein, an "image" is an ink-based design, pattern, artwork, figure, or picture that is printed on a substrate (preferably paper) in any shape or size.

A "transferable ink" is an ink that is transferable from a substrate (preferably paper) to a dough when a user presses the dough onto the substrate with sufficient force to cause the ink to transfer onto the dough. A "transferable image" is an image that comprises or consists of transferable ink, and that is transferable from a substrate (preferably paper) to a dough when a user presses the dough onto the substrate with sufficient force to cause the transferable ink to transfer onto the dough. According to preferred embodiments, the transferable ink comprises or consists of one or more cold-set web inks that are commonly used in the art for printing with cold-set web presses.

"Non-transferable ink" is ink that is not transferable from a substrate (preferably paper) to a dough when a user presses the dough onto the substrate with the amount of force that would be sufficient to cause a transferable ink printed on the same substrate to transfer onto the dough. A "non-transferable image" is an image that comprises or consists of non-transferable ink, and that is not transferable from a substrate (preferably paper) to a dough when a user presses the dough onto the substrate with the amount of force that would be sufficient to cause a transferable ink printed on the same substrate to transfer onto the dough. According to preferred embodiments, the non-transferable ink comprises or consists of one or more sheet-fed offset inks or heat-set web inks that are commonly used in the art for printing with sheet-fed offset presses or heat-set offset presses, respectively. According to exemplary embodiments, the non-transferable ink comprises or consists of one or more sheet-fed offset inks that are commonly used in the art for printing with sheet-fed offset presses.

The transferable ink and non-transferable ink that make up an image may each be any single color or multiple colors; for example, black, red, blue, orange, pink, green, yellow, purple, etc. According to particular embodiments, the non-transferable ink color could be dark, such as black, or any color gamut that best mask out the hidden image within the non-transferable ink when it overlays or underlays the non-transferable ink on the substrate. According to particular embodiments, an image comprises transferable ink and non-transferable ink that are the same color (e.g., black). The transferable ink and non-transferable ink alternatively comprise different colors.

As used herein, a "dough" is a moldable composition or a putty that a user can manipulate into desired shapes. According to preferred embodiments, the dough comprises one or more silicone polymers, such as polydimethylsiloxane (PDMS) (e.g., in an amount of at least about 10%, at least about 20%, at least about 30%, at least about 40%, at least about 50%, or at least about 60%). For example, the dough may comprise or consist of components selected from the group consisting of PDMS, silica, glycerin, dimethyl siloxane (hydroxyl-terminated polymers with boric acid), one or more optional additives (e.g., titanium dioxide for added "whiteness," thixotrol (a castor oil derivative), dimethyl cyclosiloxane, one or more thickeners, one or more preservatives and/or one or more colorants), and a combination thereof. According to exemplary embodiments, the dough is Silly Putty® (e.g., Dow Corning® Q2-3233 or Depco® D-118) with one or more additional optional components (e.g., titanium dioxide or a texturizing agent) added to the Silly Putty® to provide a preferred color or texture. For example, the dough may comprise Silly Putty® with additional titanium dioxide added to the composition (e.g., 1 wt % titanium dioxide). The dough may be any color, but is preferably white so that the transferred image stands out clearly against the white background.

According to preferred embodiments, the substrate is paper. The paper is preferably fibrous paper comprising or consisting of fibers, such as pulp derived from wood or grasses. The paper preferably has a caliper between 4 to 8, more preferably between 5 to 7, most preferably about 6. The types of paper used in exemplary embodiments include 50# Abibow® Alternative Book, 6 caliper and 45# Norbrite® 70 Insert, 6 caliper. According to alternative embodiments, the substrate is a paper that comprises one or more plastics, such as polypropylene (e.g., Yupo® brand), polyethylene (e.g., Terraskin® brand, about 75% $CaCO_3$ and about 25% polyethylene) and/or cellulose acetate.

The "second substrate" onto which an image is transferred is preferably physically separate from the substrate on which the image comprising transferable ink and non-transferable ink is printed (e.g., the second substrate is a second piece of paper that is physically separate from the printed substrate). However, the substrate comprising the original image and the second substrate may alternatively comprise two different areas of the same substrate, e.g., an image comprising transferable and non-transferable ink is printed on one area of a piece of paper and the transferable ink can be transferred to another area of the same piece of paper (the second substrate).

According to one embodiment, a user molds or presses the dough so that at least one side (the underside) is substantially flat, places the underside of the dough onto the image printed on the substrate so that it covers the entire image or a portion of the image, and presses firmly (i.e., with sufficient force to cause transferable ink printed on the substrate to transfer to the dough). For example, a user may use one or more fingers to press down firmly on the dough. After lifting the dough off of the image, the user can see the image on the underside of the dough, which comprises only transferable ink from the hidden image (this will be a mirror image of the original hidden image printed on the substrate). The underside of the dough with the hidden image printed thereon may then be pressed onto the surface of a second substrate, so that the hidden image can be transferred to the second substrate. Preferably, the image that is transferred to the second substrate is identical or substantially identical to the original transferable image (hidden image) printed on the substrate.

According to preferred embodiments, the method can be performed on the same image multiple times, i.e., all of the transferable ink is preferably not transferred to the dough the first time the dough is pressed onto the image, so that dough can be pressed onto the same image at least one more time, preferably several times, and can pick up the transferable image each additional time. Eventually, after enough uses, there will not be enough transferable ink left on the surface of the substrate to transfer onto the dough.

It should also be noted that, after the transferable ink has been transferred from the dough to the second substrate, some of the transferable ink may still remain on the dough. However, the method can preferably be performed multiple times with the same piece of dough (i.e., one piece of dough is preferably reusable). After an image has been transferred to the dough (and optionally transferred to a second substrate), and the dough has an image comprising transferable ink still imprinted thereon, a user can manually mold the dough (e.g., by folding and/or squeezing the dough several times) until the transferable ink becomes mixed into the dough and the image is no longer visible on a surface of the dough. The dough can then be used again to transfer another image or the same image. The dough may gradually become darker in color (e.g., gray in color) the more times it is used to transfer an image and is subsequently re-molded, particularly if the dough is originally white, as some transferable ink will become mixed into the dough each time it is reused. A user may alternatively use a new piece of dough each time he or she transfers an image from the substrate.

In order to print both transferable and non-transferable inks onto a substrate to provide the "secret reveal" capabilities of the present invention, the applicants developed a printing process in which sheet-fed offset presses are used to print both cold-set web inks and sheet-fed offset inks onto the same substrate. According to alternative embodiments, a heat-set offset press may be used to print both cold-set web inks and heat-set offset inks onto the same substrate. As discussed in more detail below, the inks developed for cold-set web presses (i.e., cold-set web inks) are not normally used on a different type of press, such as a sheet-fed offset press or heat-set offset press, as these types of presses are very different from each other and use different types of inks (i.e., sheet-fed offset inks are used with sheet-fed offset presses and heat-set offset inks are used with heat-set offset presses). However, it was surprisingly discovered that a sheet-fed offset press could be used to print both cold-set web inks, which are transferable onto dough, and sheet-fed offset inks, which are not transferable onto dough, onto the same substrate.

An embodiment of the present invention provides a method for making a substrate with at least one image comprising transferable ink and non-transferable ink printed thereon, the method comprising using a sheet-fed offset press or heat-set offset press to print the image onto a surface of the substrate, the image comprising transferable ink and non-transferable ink, wherein the transferable ink comprises one or more cold-set web inks. The non-transferable ink preferably comprises one or more sheet-fed offset inks or heat-set offset inks, most preferably one or more sheet-fed offset inks.

Cold-set web inks have comparably high mineral oil content, low resin content, and low viscosity compared to sheet-fed offset and heat-set offset inks. Cold-set web inks are designed to dry by absorption onto paper and by air. On the contrary, the inks for sheet-fed offset presses and heat-set offset presses are petroleum oil-based or vegetable/soy oil-based and have resins and driers built in to ensure the inks cure to a hardened state. Sheet-fed presses typically have IR or UV driers, and heat-set presses typically have natural/propane gas drying units that help cure the ink. The inks for sheet-fed offset and heat-set web offset are designed to cure, preferably completely, either during the printing process or through oxidation and chemical reactions soon thereafter. Cold-set presses and inks are much different. Generally, cold-set printing does not require built-in driers for curing the ink, as cold-set inks are developed to dry by absorption onto paper and by air.

Cold-set web presses are generally considered to provide lower quality printing (e.g., lower resolution) in comparison to sheet-fed offset and heat-set offset presses. The viscosities of inks used with sheet-fed presses are typically much higher in comparison to cold-set web inks, and can therefore print with much higher resolution. Lower viscosity inks tend to expand too much on the substrate to provide the level of resolution provided by sheet-fed presses and inks. Heat-set web offset presses provide similar quality printing as sheet-fed offset presses, but are typically used for higher volume runs. Heat-set web inks typically have silicone in them, and are developed specifically for the type of substrate that will be printed.

Another embodiment of the present invention provides a kit comprising at least one substrate, wherein at least one image is printed on the surface of each substrate, and each image comprises transferable ink and non-transferable ink. According to preferred embodiments, the kit further comprises one or more pieces of dough, preferably a putty, such as Silly Putty®. The at least one substrate preferably comprises at least one piece of paper. According to preferred embodiments, the kit comprises multiple pieces of paper (e.g., fibrous paper that preferably has a caliper between 4 to 8, more preferably between 5 to 7, most preferably 6, as described above). For example, the kit may comprise a "book" (e.g., a "putty transfer book" or "Silly Putty® Transfer Book") which includes several pieces of paper bound together, each piece of paper having one or more images printed thereon. Multiple images are preferably printed on each piece of paper (e.g., two, three, or four separate images). The kit may also include instructions for a user to carry out one or more methods of the invention described herein, e.g., to press at least a portion of the dough onto the image printed on the substrate, and to optionally press the dough onto a second substrate. The kit may optionally include at least one "second substrate" (e.g., one or more pieces of paper onto which images may be transferred).

Although the present invention has been described in connection with specific embodiments, it should be understood that the invention as claimed should not be unduly limited to such specific embodiments. Indeed, various modifications and variations of the described compositions and methods of the invention will be apparent to those of ordinary skill in the art and are intended to be within the scope of the appended claims.

What is claimed is:

1. A kit comprising:

at least one substrate, wherein at least one image is printed on each substrate, each image comprising transferable ink and non-transferable ink, wherein one or more portions of each image comprise both non-transferable ink and transferable ink printed on top of each other, wherein the transferable ink is transferable from the substrate to a dough when a user presses the dough onto the substrate with sufficient force to cause the ink to transfer onto the dough, and wherein the non-transferable ink is not transferable from the substrate to a dough when a user presses the dough onto the substrate with the amount of force that would be sufficient to cause a transferable ink printed on the same substrate to transfer onto the dough.

2. The kit of claim 1 further comprising one or more pieces of dough.

3. The kit of claim 1, wherein the at least one substrate comprises at least one piece of paper.

4. The kit of claim 3, wherein the kit comprises multiple substrates, and the substrates are pieces of paper.

5. The kit of claim 1, wherein multiple images are printed on the surface of each substrate.

6. The kit of claim 1, wherein the transferable ink comprises one or more cold-set web inks.

7. The kit of claim 1, wherein the non-transferable ink comprises one or more sheet-fed offset inks or one or more heat-set offset inks.

8. The kit of claim 7, wherein the non-transferable ink comprises one or more sheet-fed offset inks.

9. The kit of claim 1, wherein one or more portions of the image comprise only non-transferable ink or only transferable ink.

* * * * *